United States Patent [19]

Donovan

[11] Patent Number: 4,659,109

[45] Date of Patent: Apr. 21, 1987

[54] BINDER AND FOLDER FOR USE THEREWITH

[76] Inventor: Robert G. Donovan, 15 East La., Pittston, Pa. 18640

[21] Appl. No.: 820,317

[22] Filed: Jan. 21, 1986

[51] Int. Cl.[4] ..... B42D 1/06; B42D 17/00; B42D 7/00; B42F 15/00

[52] U.S. Cl. ..... 281/46; 281/31; 281/48; 40/404

[58] Field of Search ..... 281/31, 33, 46, 47, 281/48, 49, 50; 283/64; 402/500, 501; 40/404, 36

[56] References Cited

U.S. PATENT DOCUMENTS

| | | | |
|---|---|---|---|
| 1,051,453 | 1/1913 | Roedde | 281/48 |
| 3,680,969 | 8/1972 | Gorman | 281/31 |
| 3,870,223 | 3/1975 | Wyant | 281/31 |
| 3,950,012 | 4/1976 | Donovan | 40/404 |
| 3,971,572 | 7/1976 | Fenkel | 281/46 |
| 4,336,754 | 6/1982 | Loeb | 281/31 |
| 4,519,630 | 5/1985 | Holmes | 281/31 |

*Primary Examiner*—Paul A. Bell
*Assistant Examiner*—Paul M. Heyrana, Sr.
*Attorney, Agent, or Firm*—John P. Snyder

[57] ABSTRACT

A binder for multi-leafed devices has a pair of spaced brackets each of which has a plurality of prongs extending toward the other bracket. The prongs of one bracket are longer than those of the other bracket and are spaced so as to permit the prongs to be inserted into a multi-leafed device. A stop member is swingably mounted adjacent the bracket with the longer prongs for engaging the prongs and preventing inadvertent release of the multi-leafed device. The stop member is locked in operative position by a projection thereon snugly received in a recess formed in a portion fixed relative to the binder. A folder is provided with a notch therein permitting one of the shorter prongs to be inserted within the folder even though the folder is of greater length than conventional multi-leafed devices used with the binder. The folder defines a first pair of open-ended pockets, a pair of integral flaps on the folder overlying the open ends of the pocket. An integral folded over tab is provided to resist tearing of the folder. The folder is provided with a second pair of open-ended pockets to increase its storage capacity.

20 Claims, 6 Drawing Figures

FIG. 3
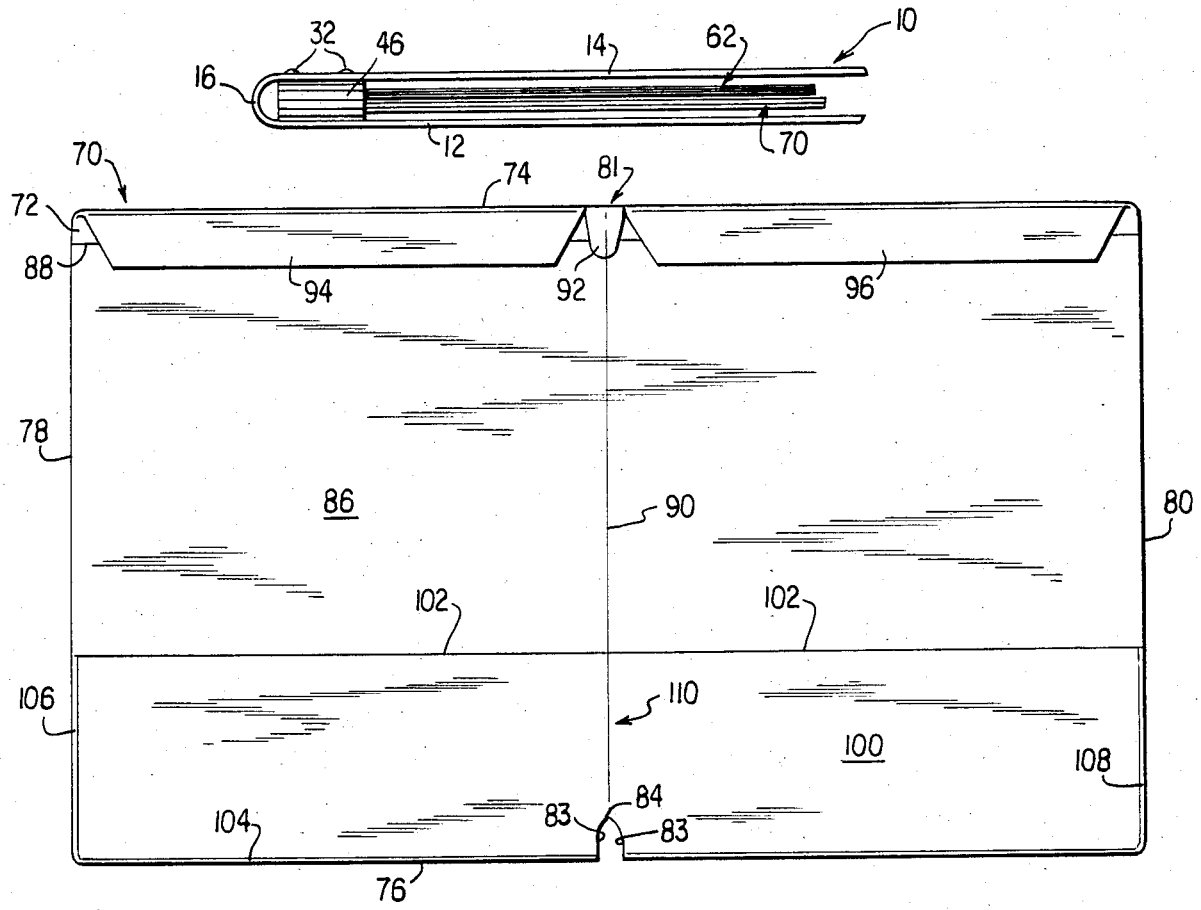
FIG. 4
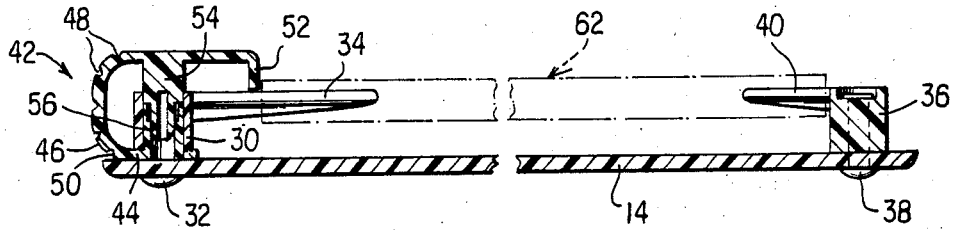
FIG. 5
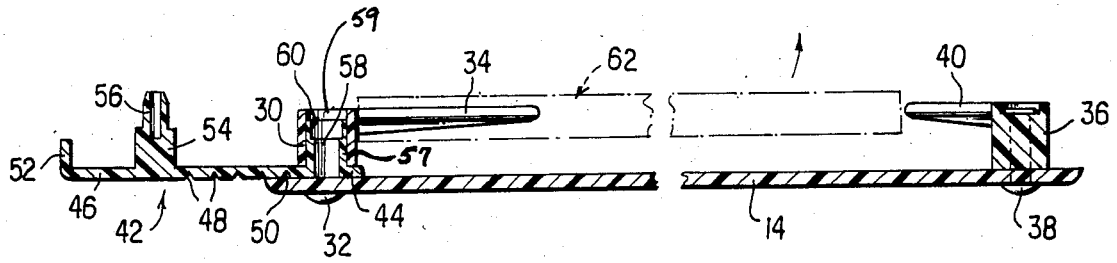
FIG. 6

BINDER AND FOLDER FOR USE THEREWITH

BACKGROUND OF THE INVENTION

The present invention relates to binders for storing multi-leafed devices such as magazines, notebooks, folders and the like, wherein the multi-leafed devices may be readily inserted and held in position without the necessity of punching holes in or otherwise modifying the multi-leafed devices.

This invention represents an improvement over a similar binder disclosed in U.S. Pat. No. 3,950,012 which employs a pair of spaced brackets having prongs extending toward one another, the prongs on one bracket being longer than those on the other bracket. These prongs are inserted within multi-leafed devices to store such devices within the binder. Binders of this type have certain disadvantages which it is an objective of the present invention to overcome.

In such prior art binders, means is employed to prevent inadvertent release of a multi-leafed device supported therein. In the construction of the aforementioned patent, the stop means takes the form of a metallic clip or spring which snaps over the prongs of one of the brackets to hold the multi-leafed device in place. This arrangement is unsatisfactory since it is relatively difficult to maneuver the stop means into and out of operative position, and furthermore, the stop means may be removed and misplaced so that it is not readily available at all times. Another problem is that the stop means may be accidentally moved from is operative position so that the associated multi-leafed device may be unintentionally released.

A further problem of the construction shown in the aforementioned patent is the fact that the size of conventional multi-leafed devices that may be utilized therewith is limited by the spacing of the brackets and the length of the prongs thereon. In other words, the length of the multi-leafed device is limited to a length equal to the spacing of the opposed tips of the prongs plus the length of the longer prongs provided on one of the brackets.

The present invention also contemplates the provision of a unique folder for use with the binder. It is desirable to have a folder of greater length than conventional multi-leafed devices to accommodate loose sheets and which can be used completely independently of the binder for carrying a large number of loose papers and the like, and which at the same time may be readily mounted in the binder when so desired. U.S. Pat. No. 3,018,532 discloses foldable units which are adapted to be supported on a binder. However, such units are designed to be of relatively small dimensions so as to fit within a wallet, and are not suitable for use completely independently of the binder for holding many other sheets of material.

BRIEF SUMMARY OF INVENTION

The binder includes a pair of brackets disposed in fixed relationship to one another. Each bracket has a plurality of prongs disposed thereon extending toward the opposite bracket, the prongs on one of said brackets being longer than the prongs on the other bracket. The brackets are spaced so as to normally receive multi-leafed devices of common size such as notebooks having a length of 11". An improved stop means is provided including a first portion which is fixedly mounted on the binder adjacent the bracket having the longer prongs. In this manner, the stop means is always ready for use closely adjacent the prongs, and there is no possibility of the stop means being misplaced.

The stop means includes a second portion integral with the first portion and connected thereto along a hinge line whereby the second portion may be easily swung into and out of operative position with a minimum of effort and difficulty. A locking means includes a projection on the second portion of the stop means which fits snugly into a bore formed in the first portion of the stop means to positively ensure that the stop means is not accidentally moved out of operative position. The operation of the stop means is independent of the bracket, but in the operative position engages the prongs of the bracket to prevent the removal of multi-leaved devices.

A novel folder is provided having a length greater than 11". The folder includes a notch formed in a longitudinal edge thereof and extending along a folding portion of the folder. This notch is adapted to clear one of the shorter prongs on one of the brackets so that the folder may be disposed in supported position with a prong being received by said slot and extending into the folding portion of the folder. With this construction, a folder of greater length than conventional multi-leafed devices may be successfully supported within the binder. The folder is also of unique construction so as to provide a first pair of open-ended pockets. Flaps are provided on a longitudinal edge of the folder in overlying relationship to the open ends of the pockets for retaining material within said pockets. A tab is also provided on this longitudinal edge of the folder and is folded over adjacent the folding portion of the folder to resist tearing thereof. A further pair of open-ended pockets are provided within the folder to increase the storage capacity thereof.

The folder may be utilized completely independently of the binder and is adapted to carry many separate documents in the pockets thereof. The folder is of such construction and appearance that it is suitable for carrying and storing items without the necessity of being mounted in a binder, and yet it may be quickly and easily supported within the binder when so desired.

BRIEF DESCRIPTION OF THE DRAWINGS

FIG. 3 is an end view of the assembly shown in FIG. 1 in closed position.

FIG. 4 is a view of a folder according to the present invention in open position;

FIG. 5 is a sectional view taken along line 5—5 of FIG. 1 looking in the direction of the arrows; and FIG. 6 is a sectional view taken along line 6—6 of FIG. 2 looking in the direction of the arrows.

DETAILED DESCRIPTION OF THE INVENTION

Figure 1:
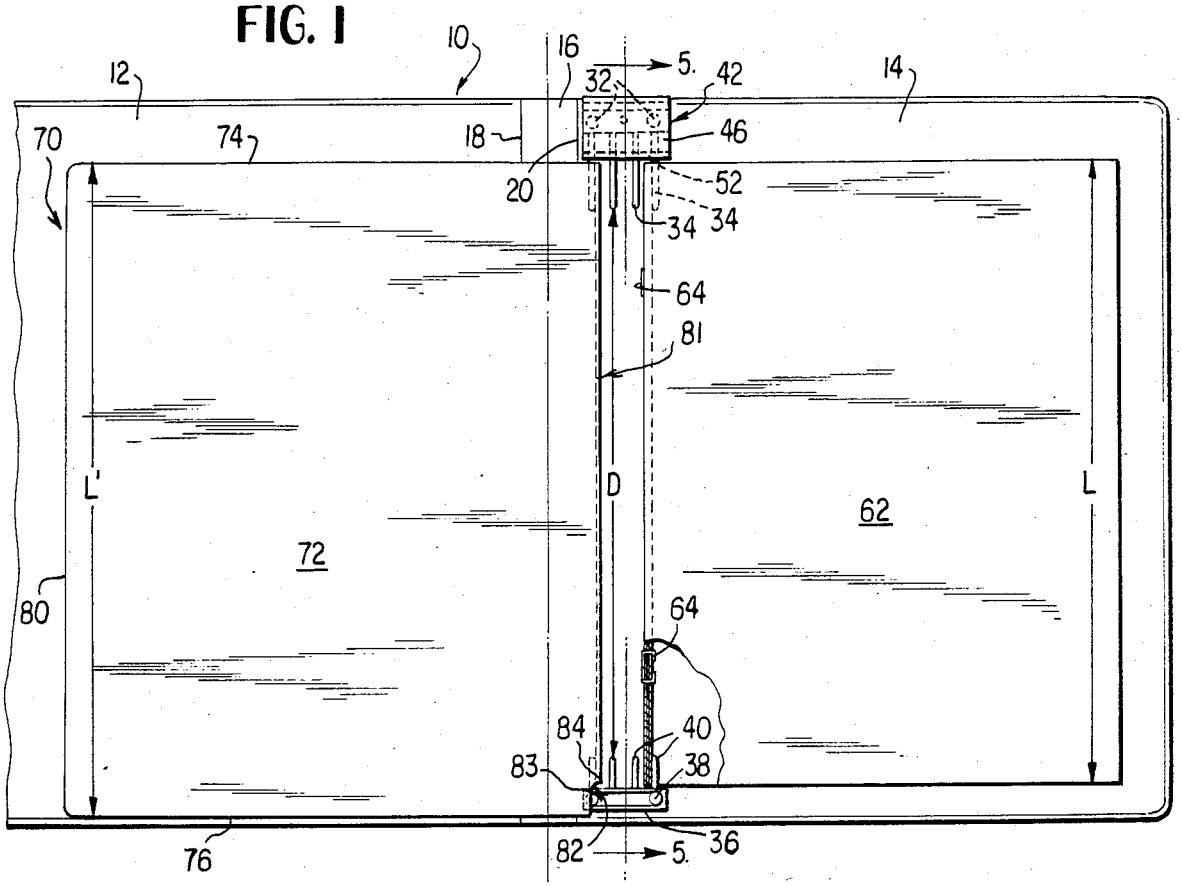
FIG. 1 is a top view of a folder in open position with a conventional notebook and a folder according to the present invention supported therein.
Figure 2:
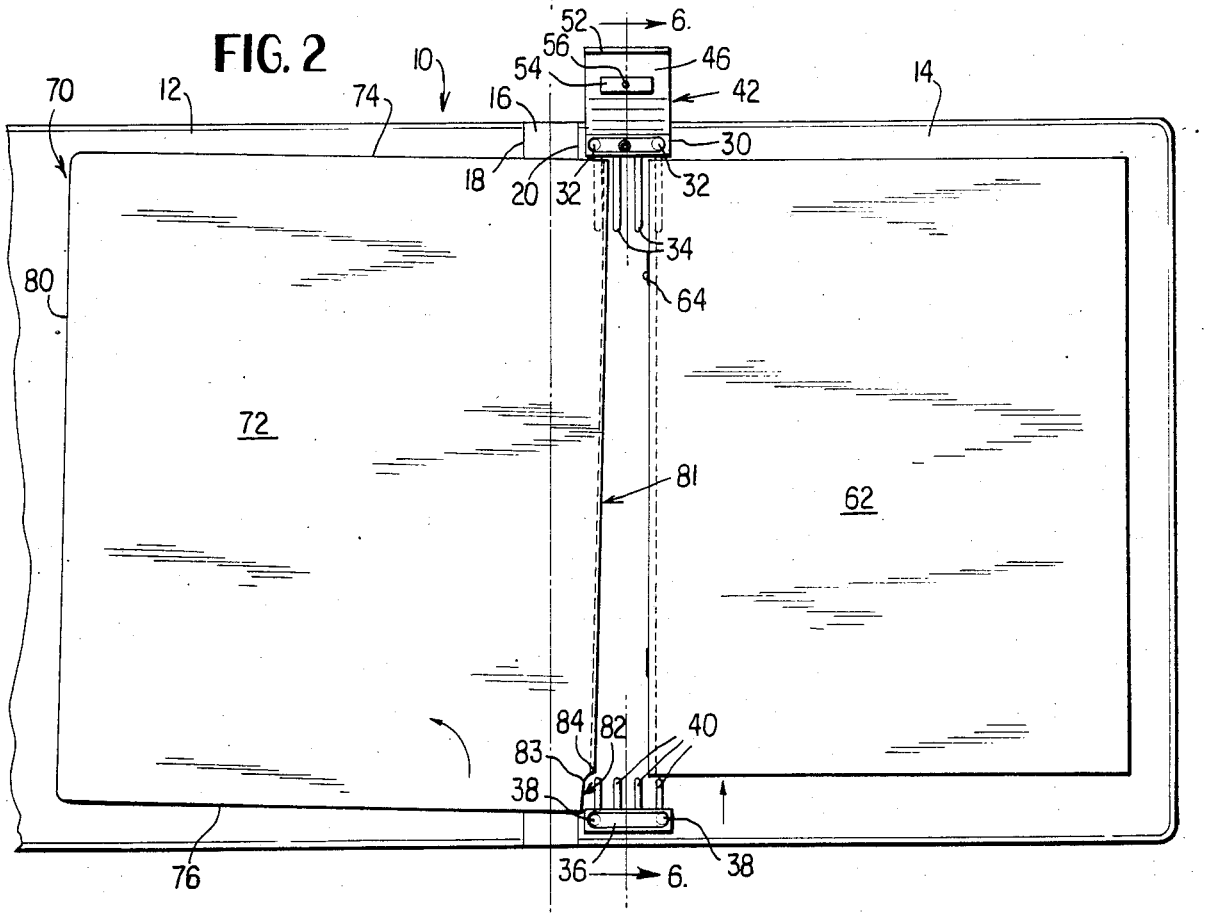
FIG. 2 is a view similar to FIG. 1 wherein the stop means has been moved from its operative position and the notebook and folder have been moved upwardly as seen in this figure.

Referring now to the drawings wherein like reference characters designate corresponding parts throughout the several views, there is shown in FIGS. 1–3 a binder indicated generally by reference numeral 10 including a front cover portion 12 and a back cover portion 14, the cover portions being of relatively stiff construction such as plastic or the like. The front and back cover portions are connected to a relatively thin flexible plastic back portion 16 along hinge lines 18 and 20 respectively whereby the cover portions are interconnected to one another for swinging movement between the open position shown in FIGS. 1 and 2 and the closed position shown in FIG. 3.

A first bracket 30 formed of plastic or metal is fixedly secured to cover portion 14 by a pair of rivets 32 extending through suitable holes formed in the bracket and cover portion. Bracket 30 is provided with a plurality of spaced integral prongs 34 extending therefrom toward an opposite bracket hereinafter described. The prongs are shown for example as being four in number and in a typical example may be $1\frac{1}{4}''$ in length.

A second bracket 36 which is formed of plastic or metal is fixedly secured to cover portion 14 by a pair of rivets 38 extending through suitable holes formed in the bracket and cover portion. Bracket 36 is provided with a plurality of spaced integral prongs 40 extending therefrom toward the first bracket 30. Prongs 40 are also shown as being four in number and in a typical example may be 9/16" in length. The opposed tips of the prongs on the two brackets are spaced from one another in a typical example a distance D of $9\frac{3}{4}''$.

A stop means indicated generally by reference numeral 42 is provided for retaining multi-leafed devices in supported position within the binder. The stop means which may be formed of plastic or metal includes a first portion 44 which as seen in FIGS. 5 and 6 is clamped between cover portion 14 and bracket 30, rivets 32 also extending through suitable holes provided in portion 44. Portion 42 of the stop means includes an integral upstanding cylindrical portion 57 which is received within a complementary hole 59 formed through bracket 30. A stepped bore is provided through cylindrical portion 57 including a first cylindrical portion 58 and a second portion 60 of greater diameter.

A second portion 46 of the stop means is formed integral with portion 44 and is provided with a plurality of V-shaped grooves 48 formed in one side of a part thereof and which extend throughout the width thereof so that this part of portion 46 may bend into the configuration as seen in FIG. 5. The lowermost groove as seen in this figure forms a hinge line 50 at the bottom of the groove whereby portion 46 is interconnected with portion 44 for swinging movement. The stop means includes a lip 52 which is adapted to be moved into operative position so that the under surface thereof is adjacent prongs 34.

A locking means is provided for locking the stop means in the operative position shown in FIGS. 5 and 6, the locking means comprising an integral portion 54 from which extends a generally cylindrical part 56 having a tapered end thereon. Part 56 is snugly received within the previously described portion 58 of the bore formed in the upstanding portion 57 of the stop means. The lower part of portion 54 of the locking means is received within the portion 60 of the bore.

Referring to FIG. 1 of the drawings, a conventional notebook 62 is shown supported within the binder with the righthand-most of the prongs 34 and 40 inserted within the sheets of the notebook. The notebook has staple means 64 for holding the sheets of the notebook in assembled relationship, and the notebook has a length L which may typically be 11". The distance D between the opposed tips of the prongs on the brackets is less than the length of the notebook, the distance D plus the length of the prongs of the first bracket being at least as great or greater than the length of the notebook, while said distance plus the length of the prongs on the second bracket is less than the length of the notebook. The relationship of distance D, the lengths of the prongs on the two brackets and the length L will be the same for any conventional multi-leafed device supported in the binder.

Referring now to FIG. 4 of the drawings, a folder indicated generally by reference numeral 70 includes a first sheet of material 72 formed for example of plastic and having opposite longitudinal edges 74 and 76 and side edges 78 and 80 extending between corresponding ends of said longitudinal edges. A folding portion 81 of the sheet extends between longitudinal edges 74 and 76 and is generally parallel to the side edges 78 and 80. Edge 76 has a notch 82 formed therein which extends along folding portion 81. The notch has sides 83 and an inner end 84. As seen in FIGS. 1 and 2, the folder is adapted to be folded along folding portion 81 into a closed position wherein the side edges 78 and 80 will be aligned with one another, and when in such folded position, the sides of the slot are positioned adjacent one another for receiving one of the prongs 40.

The folder includes a second sheet of material 86 formed for example of plastic and having opposite longitudinal edges and side edges extending between corresponding ends of said longitudinal edges. The second sheet is disposed in overlying relation to the first sheet as seen in FIG. 4. The side edges of the second sheet extend along the side edges 78 and 80 of the first sheet and are secured thereto in a suitable manner as by heat sealing. The lower longitudinal edge of sheet 86 as seen in FIG. 4 is coextensive with and suitably secured as by heat sealing to the longitudinal edge 76 of sheet 72. The opposite longitudinal edge 88 of sheet 86 is spaced from the opposite longitudinal edge 74 of sheet 72. The medial portion of second sheet 86 extends generally parallel with the associated side edges of sheet 86 and is secured to the folding portion 81 of the first sheet 72 as by an adhesive or heat sealing along the line 90.

With the construction described above, sheets 72 and 86 cooperate to define a pair of pockets on opposite sides of line 90, the pockets being closed along their side and bottom edges and being open at the free upper edge 88 of sheet 8.

A tab 92 is formed integral with the longitudinal edge 74 of sheet 72, the tab being folded over adjacent the folding portion 81 of the folder. This tab resists tearing of the first sheet at the folding portion thereof.

A pair of spaced flaps 94 and 96 are also formed integral with the longitudinal edge 74 of sheet 72. These flaps are folded over so as to be in overlying relation to the open end of each of the pockets defined between sheets 72 and 86. In this manner, any loose documents will be retained within the open-ended pockets. When it is desired to remove any documents, the flaps may simply be flipped upwardly as seen in FIG. 4.

A third sheet of material 100 which may also be of plastic is disposed in overlying relation to sheet 86 as seen in FIG. 4. This third sheet has opposite longitudinal edges 102 and 104 and side edges 106 and 108 extending between corresponding ends of said lontitudinal edges. The side edges and longitudinal edge 104 are suitably secured to sheet 86 as by heat sealing, and an intermediate portion 110 of the third sheet is secured to the intermediate portion of sheet 86 as by heat sealing or an adhesive along line 90 previously decribed. The opposite longitudinal edge 102 of sheet 100 is free of sheet 86 except where connected thereto along line 90 so as to define a further pair of pockets between sheets 86 and 100 which are closed along their side and bottom, edges and open at the free upper edge 102. These pockets can receive items in addition to those received by the previously defined open-ended pockets between sheets 72 and 86.

In a typical construction, sheets 72 and 100 may be formed of opaque material, while sheet 86 may be formed of transparent material so that the contents of the pockets formed between sheets 72 and 86 are visible when the folder is opened.

Referring now to FIG. 2 of the drawings, the manner in which a notebook is mounted in the binder is illustrated. The stop means 42 is moved into the open position shown and the notebook is then moved so that one of the prongs 34 is inserted therein. The notebook is then moved upwardly as seen in this figure so that the lower edge thereof will clear an adjacent prong 40. The notebook can then be moved downwardly into the position shown in FIG. 1.

The folder 70 is of greater length than the notebook and in a typical example has a length L' of $11\frac{5}{8}''$. The length of the folding portion of the folder from the inner end 84 of the notch to the opposite longitudinal edge 74 is 11". Accordingly, the length of the folder between the longitudinal edges thereof is greater than the distance D between the opposed tips of the prongs of the brackets plus the length of the prongs on bracket 42. The length of the folding portion of the folder from the inner end 84 of the notch to the opposite longitudinal edge 74 of the folder is no greater or less than the distance D plus the length of the prongs on bracket 42 and also is greater than distance D plus the length of the prongs on bracket 36.

When folder 70 is to be mounted in supported position, the folder is folded as shown in FIG. 2 and the notch will clear an adjacent prong 40. The folder can then be moved downwardly into the position shown in FIG. 1 with a prong 40 being received through the slot 82 and extending into the folding portion 81. The stop means is then moved from the position shown in FIGS. 2 and 6 into the position shown in FIGS. 1 and 5 whereupon the multi-leafed devices are retained in supported position. When it is desired to remove the devices, the procedure can simply be reversed.

What is claimed is:

1. In combination, a binder for a multi-leafed device, and a multi-leafed device, said binder including cover portions interconnected for movement relative to one another between open and closed positions, said binder including a portion of stiff construction, a pair of spaced brackets secured to said stiff binder portion so as to be disposed in fixed spaced relation to one another, each bracket having a plurality of spaced prongs extending therefrom toward the other bracket, the prongs on a first one of said brackets being longer than the prongs on a second one of said brackets, the distance between the opposed tips of the prongs on the brackets being less than the length of said multi-leafed device, said distance plus the length of the prongs on said first bracket being at least as great as the length of said multi-leafed device, said distance plus the length of the prongs on said second bracket being less than the length of said multi-leafed device, at least one prong of each of said brackets being inserted between leafs of said multi-leafed device with said multi-leafed device being freely movable along said prongs, and stop means selectively movable to prevent inadvertent release of said multi-leafed device from said prongs so as to retain the multi-leafed device within the binder, the improvement wherein said stop means includes a first portion fixedly mounted on said binder adjacent said first bracket, and a second portion movably connected to said first portion for movement into and out of engagement with the prongs of said first bracket, said second portion when in engagement with the prongs of said first bracket including a surface for engaging a lateral edge of the multi-leafed device to limit movement of said multi-leafed device along the prongs of said first bracket so as to retain at least one prong of each of said brackets inserted between leafs of said multi-leafed device.

2. The combination of claim 1 wherein said first and second portions of the stop means are integral with one another and are interconnected along a hinge line to permit swinging movement of said second portion relative to said first portion.

3. The combination of claim 1 including locking means for locking the stop means in position to prevent inadvertent release of said multi-leafed device.

4. The combination of claim 3 wherein said locking means includes a first locking portion on one of said stop means portions, and a second locking portion on the other of said stop means portions for cooperatively engaging said first locking portion.

5. The combination of claim 4 wherein said first locking portion comprises a projecting part and said second locking portion defines a complementary recess for snugly receiving said projecting part.

6. The combination of claim 1 wherein said first portion of the stop means is clamped between said stiff binder portion and said first bracket to fixedly mount the stop means adjacent the first bracket.

7. The combination of claim 6 wherein said first portion of the stop means has an integral portion extending therefrom, said first bracket defining a complementary hole receiving said integral portion on the first portion of the stop means.

8. In combination, a binder for a multi-leafed device, and a multi-leafed device comprising a folder, said folder having opposite longitudinal edges and side edges extending between corresponding ends of said longitudinal edges, said folder including a folding portion extending between said longitudinal edges and generally parallel to said side edges, one of said longitudinal edges having a notch formed therein and extending along said folding portion, said notch having sides and an inner end, said binder including cover portions interconnected for movement relative to one another between open and closed positions, said binder including a portion of stiff construction, a pair of spaced brackets secured to said stiff binder portion so as to be disposed in fixed spaced relation to one another, each bracket having a plurality of spaced prongs extending therefrom toward the other bracket, the prongs of a first one of said brackets being longer than the prongs on a second one of said brackets, the length of said folder between said longitudinal edges being greater than the distance between the opposed tips of the prongs on the brackets plus the length of the prongs on said first bracket, the length of said folding portion from the inner end of the notch to the opposite longitudinal edge being no greater than said distance plus the length of the prongs on said first bracket and also being greater than said distance plus the length of the prongs on said second bracket, at least one prong of each of said brackets being inserted into said folding portion with said folder being freely movable along said prongs, and stop means selectively movable to limit movement of said folder along the prongs of said first bracket so as to retain at least one prong of each of said brackets inserted into said folding portion and thereby prevent inadvertent release of said folder from said prongs and retain the folder within the binder.

9. The combination of claim 8 wherein the folded portion of the folder is positioned substantially midway between said side edges, said slot being located such that when the folder is in folded position, the sides of the slot are positioned adjacent one another so that one of the prongs of said second bracket is received through said slot and extends within said folding portion.

10. The combination of claim 8 wherein said stop means includes a first portion fixedly mounted on said binder adjacent said first bracket, and a second portion movably connected to said first portion for movement into and out of engagement with the prongs of said first bracket.

11. The combination of claim 8 wherein said first and second portions of the stop means are integral with one another and are interconnected along a hinge line to permit swinging movement of said second portion relative to said first portion.

12. The combination of claim 8 including locking means for locking the stop means in position to prevent inadvertent release of said folder.

13. The combination of claim 12 wherein said locking means includes a first locking portion on one of said stop means portions, and a second locking portion on the other of said stop means portions for cooperatively engaging said first locking portion.

14. The combination of claim 13 wherein said first locking portion comprises a projecting part and said second locking portion defines a complementary recess for snugly receiving said projecting part.

15. A folder adapted to be mounted on prongs in an associated binder and comprising a first sheet of material having opposite longitudinal edges and side edges extending between corresponding ends of said longitudinal edges, said first sheet of material including a folding portion extending between said longitudinal edges generally parallel to said side edges, one of said longitudinal edges having a notch formed therein and extending along said folding portion, a second sheet of material having opposite longitudinal edges and side edges extending between corresponding ends of said longitudinal edges, said second sheet of material being disposed adjacent said first sheet of material, the side edges of said first sheet being secured to the side edges of said second sheet, an intermediate portion of said second sheet extending generally parallel with the associated side edges and being secured to said folding portion of said first sheet, one longitudinal edge of said second sheet being secured to one longitudinal edge of said first sheet, the opposite longitudinal edge of said second sheet being spaced from the opposite longitudinal edge of said first sheet to define a plurality of open-ended pockets within said folder between said first and second sheets.

16. A folder as defined in claim 15 including a tab on said opposite longitudinal edge of said first sheet and folded over adjacent said folding portion to resist tearing of said first sheet at the folding portion thereof.

17. A folder as defined in claim 15 including at least one flap on said opposite longitudinal edge of said first sheet, said flap overlying the open end of one of said pockets.

18. A folder as defined in claim 15 including a tab on said opposite longitudinal edge of said first sheet and folded over adjacent said folding portion, to resist tearing of said first sheet at the folding portion thereof, a pair of spaced flaps on said opposite longitudinal edge of said first sheet, each of said flaps overlying the open end of one of said pockets.

19. A folder as defined in claim 15 including a third sheet of material having opposite longitudinal edges and side edges extending between corresponding ends of said longitudinal edges, the third sheet of material being disposed adjacent said second sheet of material, the side edges of said third sheet being secured to the side edges of said second sheet, an intermediate portion of said third sheet being secured to said intermediate portion of said second sheet, one longitudinal edge of said third sheet being secured to said one longitudinal edge of said second sheet, the opposite longitudinal edge of said third sheet being spaced from said opposite longitudinal edge of said second sheet to define a further plurality of open-ended pockets within said folder between said second and third sheets.

20. A folder as defined in claim 19 including a tab on said opposite longitudinal edge of said first sheet and folded over adjacent said folding portion, means for holding said tab in folded over position to resist tearing of said first sheet at the folding portion thereof, and a pair of spaced flaps on said opposite longitudinal edge of said first sheet, each of said flaps overlying the open end of one of said pockets defined between said first and second sheets.

* * * * *